US005186023A

United States Patent [19]

Goldberg

[11] Patent Number: 5,186,023

[45] Date of Patent: Feb. 16, 1993

[54] RINGS THAT OPEN AND CLOSE

[76] Inventor: Gary J. Goldberg, 6728B Boca Pines Trail, Boca Raton, Fla. 33433

[21] Appl. No.: 859,916

[22] Filed: Mar. 30, 1992

[51] Int. Cl.[5] ..... A44C 9/02

[52] U.S. Cl. ..... 63/15.5; 63/15.65

[58] Field of Search ..... 63/15.45, 15.5, 15.6, 63/15.65

[56] References Cited

U.S. PATENT DOCUMENTS

| | | | |
|---|---|---|---|
| 250,195 | 11/1881 | Booraem . | |
| 293,831 | 2/1884 | Wickers | 63/15.5 |
| 1,296,435 | 3/1919 | Schmidt . | |
| 1,409,138 | 3/1922 | Fontana . | |
| 1,558,418 | 10/1925 | Wendel | 63/15.65 |
| 2,146,272 | 2/1939 | Skoog | 63/15.65 |
| 4,215,556 | 8/1980 | Mroz | 63/15.6 |
| 4,245,485 | 1/1981 | Bushong | 63/15.6 |
| 4,261,185 | 4/1981 | Martinez | 63/15.6 |

FOREIGN PATENT DOCUMENTS

| | | | |
|---|---|---|---|
| 51872 | 5/1889 | Fed. Rep. of Germany | 63/15.5 |
| 1952090 | 4/1971 | Fed. Rep. of Germany | 63/15.65 |
| 16234 | 12/1912 | France | 63/15.5 |
| 2478971 | 10/1981 | France | 63/15.5 |
| 2055552 | 3/1981 | United Kingdom | 63/15.45 |

*Primary Examiner*—Renee S. Luebke
*Assistant Examiner*—Michael J. Milano
*Attorney, Agent, or Firm*—Alvin S. Blum

[57] ABSTRACT

A ring that opens and closes securely is formed from two arcuate sections hinged together at one end. A rigid section carrying ornamentation is worn on the dorsal aspect of the finger. A resilient section is worn on the ventral aspect of the finger. Overlapping partial-thickness tongues extend from the free ends of the sections. When they overlap the tongue of the rigid section is outside the tongue of the resilient section. A pin extending radially from the tongue of the rigid section toward the axis of the ring engages a radial hole in the tongue of the resilient section which receives the pin and holds the ring securely closed. When the free ends of the sections are squeezed toward the hinge ends, the resilient section flexes more so that the hole moves away from the pin to permit free opening and closing of the ring.

8 Claims, 1 Drawing Sheet

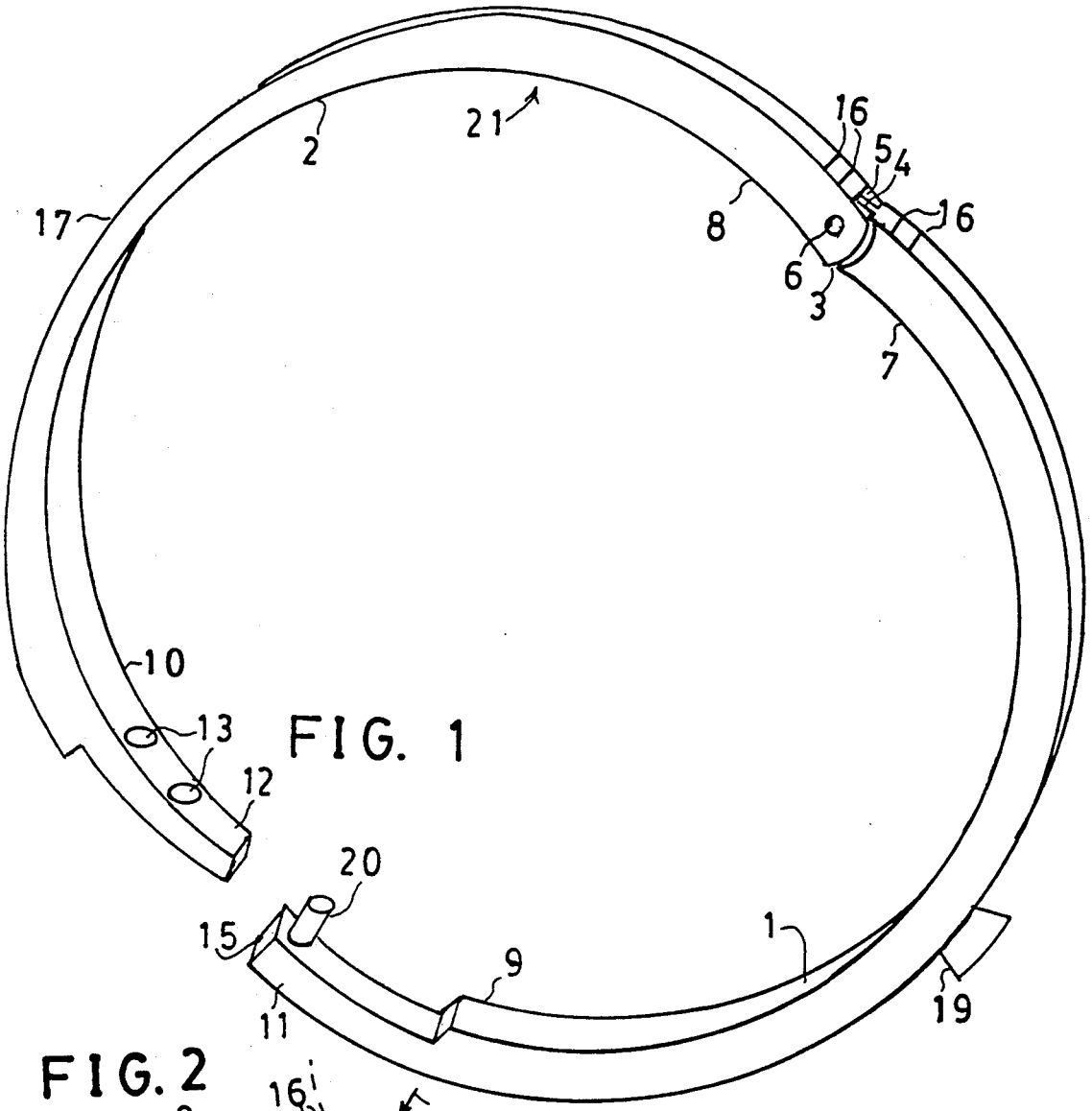
FIG. 1
FIG. 2
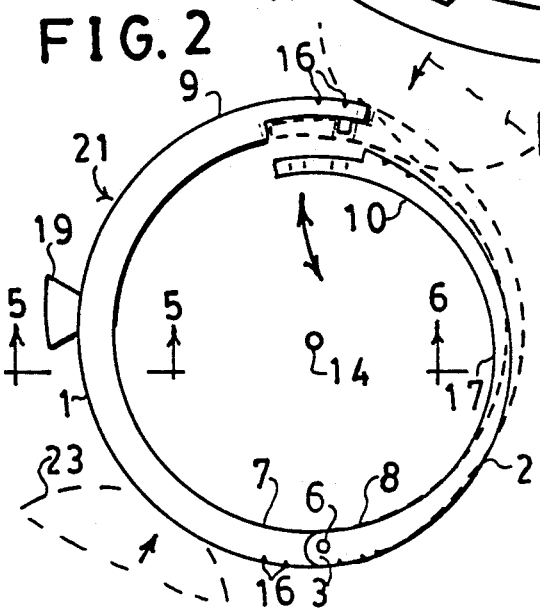
FIG. 5
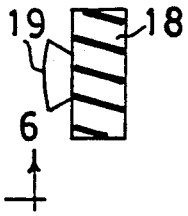
FIG. 4
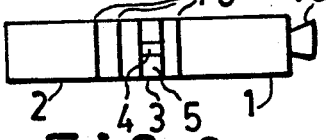
FIG. 3
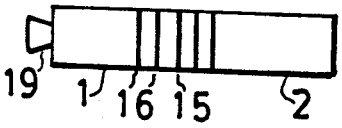
FIG. 6
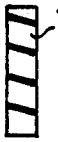

RINGS THAT OPEN AND CLOSE

FIELD OF THE INVENTION

This invention relates to jewelry, and more particularly to rings that pivot open for easier application to the body.

BACKGROUND OF THE INVENTION

Solid metal rings may be difficult to apply and remove over an enlarged knuckle. The ring may be made oversize to slide easily over the knuckle and a ring guard such as disclosed in U.S. Pat. Nos. 4,215,556 issued to Mroz and 4,245,485 issued to Bushong may be applied, but these alter the appearance.

Rings may be made in two parts that are hinged together at one end with a catch at a second end as described in U.S. Pat. Nos. 1,409,138 issued to Fontana, 250,195 issued to Booraem, 1,296,435 issued to Schmidt and U K Patent 2,005,552 issued to Cohen. These have various shortcomings in appearance, ease of operation, and difficulty in manufacture.

SUMMARY OF THE INVENTION

It is accordingly an object of the invention to provide rings of metal that give the appearance and function of solid metal bands while providing two hinged together halves that easily open and close for snug application past swollen knuckles. It is another object of the invention that the rings be adjustable to more than one diameter when closed. It is yet another object that the closing or latching mechanism be secure from accidental opening.

The rings of the invention are formed in two half hoop parts, an outer half that is rigid and provided with ornamentation such as gemstones to be applied to the dorsal part of the finger and an inner half that is flexible for application to the ventral part of the finger. The two halves are pivotally joined by a hinge means at a first end and a catch means at a second end. The catch means is formed of two overlapping, partial thickness portions of the ends of the two halves. When closed, the outer half portion covers the outer circumference of the inner half portion and a pin extending radially and centrally from the outer half portion engages one of several radial holes in the inner half portion. The inner half is elastic and flexible so that its ends may be squeezed together to cause the inner half portion to move away from the outer half portion to disengage the hole from the pin, whereupon the catch means of the ring is released. Parallel striations beside the joint lines between the halves tend to mask the joints by ornamental means.

These and other features, objects and advantages of the invention will become more apparent when the detailed description is considered in conjunction with the drawings, in which:

BRIEF DESCRIPTION OF THE DRAWINGS

FIG. 1 is a perspective view of the invention in the open condition.

FIG. 2 is a front elevation view of the invention of FIG. 1.

FIG. 3 is a side view of the catch area in closed condition.

FIG. 4 is a side view of the hinge area in closed condition.

FIG. 5 is a sectional view taken through line 5—5 of FIG. 2.

FIG. 6 is a sectional view taken through line 6—6 of FIG. 2.

DETAILED DESCRIPTION OF PREFERRED EMBODIMENT

Referring now first to FIGS. 1 and 2, the ring 21 of the invention comprises two halves hinged together, an arcuate rigid section 1 and an arcuate resilient section 2 connected by hinge 3, comprising a first end 7 of section 1 provided with a central projection 4 and a first end 8 of section 2 provided with lateral projections 5, with a hinge axle 6 pivotally connecting the projections. The rigid section may be provided with various ornamental elements 19 well known in the art such as gemstones to be worn on the dorsal surface of the finger. The rigid section 1 may be of substantial thickness for enhanced appearance. The resilient section 2 may be of lesser thickness, preferably at the portion 17 to be applied to the ventral area of the finger where it is not ordinarily visible and where a thin band is more comfortable for the wearer.

The second, or free, end 9 of section 1 is provided with a first tongue 11, from which a pin 20 extends radially toward the axis 14 of the ring. The second, or free, end 10 of section 2 is provided with a second tongue 12 that is provided with two radial holes 13 arranged to receive, in one or the other, the pin 20 when the ring is in the closed position to hold the ring securely in the closed position at one of two selectable diameters. The first tongue 11 overlaps second tongue 12 to form a substantially full thickness corresponding to the thicknesses of the free ends adjacent the tongues. The shapes of the two sections are such that pin 20 interferes with both the opening and closing of the ring unless the tongue 12 is moved toward the axis. This is accomplished by squeezing together the first and second ends 8 and 10 of the resilient section 2 with the finger 22 and thumb 23 of one hand as shown in FIG. 2. The dimensions of ring and finger are such that one will ordinarily be squeezing both sections, but the resilient section 2 flexes more than the rigid section 1 so that the hole moves away from the pin. The balls of the fingers provide flexibility for the few millimeters of motion involved in the manipulation.

It is important to provide such as easily manipulable catch means because the people who most need a ring to go over swollen knuckles are most likely to be unable to manipulate delicate and complex catches because they have arthritis of the hands or other infirmities of aging. It is ironic that by the time we can afford elegant jewelry, we have trouble wearing it. The enhanced resilience of the resilient section 2 may be provided by one or more of the following devices: thinning at least a portion 17 more than rigid section 18 (FIGS. 6 and 5); forming that section of a more resilient metal alloy; heat treatment to make it more resilient; and work hardening to make it more resilient.

Referring now to FIGS. 3 and 4, because the joints at the edge 15 of tongue 11 and the hinge 3 are visual evidence that the ring is not one homogeneous piece, parallel grooves 16 adjacent these joints may be provided. These give the appearance of delibrate ornamental striations that tend to disguise the joints.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A ring for a finger comprising:

a) an arcuate rigid section arranged for wearing on the dorsal area of a finger;

b) an arcuate resilient section arranged for wearing on the ventral area of a finger;

c) a hinge means pivotally joining a first end of said rigid section to a first end of said resilient section to enable said rigid and resilient sections to move pivotally between an open position for ready application to a finger and a closed position in which said finger is completely encircled;

d) a partial thickness first tongue means extending from a second end of said rigid section;

e) a partial thickness second tongue means extending from a second end of said resilient section;

f) said first and second tongue means arranged for overlapping one another in said closed position to form a substantially full thickness portion of said ring with said first tongue means lying away from the axis of said ring and said second tongue means lying toward said axis;

g) a pin means extending radially from said first tongue means toward said axis;

h) a hole means extending radially within said second tongue means and arranged to receive and closely engage said pin means for preventing diametral changes of said ring in said closed position by circumferential forces; and i) said resilient section being provided with so much greater resilience than said rigid section that squeezing said first and second ends of both said sections together causes said first and second ends of said resilient section to move closer together than said first and second ends of said rigid section to thereby move said hole means closer to the axis than the pin means to thereby disengage said pin means from said hole means to enable closing and opening said ring.

2. The ring according to claim 1 in which the thickness of said resilient section is, at least in part, less than that of said rigid section.

3. The ring according to claim 1 in which the sections are made of two different metals, said resilient section is made of a metal having greater resilience than the metal of said rigid section.

4. The ring according to claim 1 in which a plurality of grooves are provided adjacent to said first and second ends of at least one of said resilient and rigid sections, said grooves lying parallel to said axis and serving to conceal by ornamentation the connections between said rigid and resilient sections to give the appearance of a solid band with ornamental striations.

5. The ring according to claim 1 in which said rigid section bears ornamentation.

6. The ring according to claim 5 in which said ornamentation includes stones.

7. The ring according to claim 1 further including at least one additional hole means in said second tongue means for providing at least one additional diameter of securely engaged closed ring positions.

8. A ring for a finger comprising:

a) an arcuate rigid section arranged for wearing on the dorsal area of a finger;

b) an arcuate resilient section arranged for wearing on the ventral area of a finger;

c) a hinge means pivotally joining a first end of said rigid section to a first end of said resilient section to enable said rigid and resilient sections to move pivotally between an open position for ready application to a finger and a closed position in which said finger is completely encircled;

d) a partial thickness first tongue means extending from a second end of said rigid section;

e) a partial thickness second tongue means extending from a second end of said resilient section;

f) said first and second tongue means arranged for overlapping one another in said closed position to form a substantially full thickness portion of said ring with said first tongue means lying away from the axis of said ring and said second tongue means lying toward said axis;

g) a pin means extending radially from said first tongue toward said axis;

h) at least one hole means extending radially within said second tongue means for receiving and closely engaging said pin means in said closed position to thereby prevent movement of said pin means relative to said hole means in all but a radial direction, said pin and hole means thereby cooperating to prevent diametral changes in said ring in said closed position; and i) said resilient section being provided with so much greater resilience than said rigid section that squeezing said first and second ends of both said sections together causes said first and second ends of said resilient section to move closer together than said first and second ends of said rigid section to thereby move said hole means closer to the axis than the pin means to enable closing and opening said ring.

* * * * *